United States Patent [19]

Yasaki et al.

[11] Patent Number: 4,609,048

[45] Date of Patent: Sep. 2, 1986

[54] APPARATUS FOR AUTOMATICALLY EXTINGUISHING FIRE

[75] Inventors: Susumu Yasaki, Funabashi; Yoshinori Ishiai, Tokyo; Susumu Mitsushima, Ise; Takashi Nakamura, Chigasaki, all of Japan

[73] Assignees: Shinko Electric Co., Ltd.; Secom Co., Ltd., both of Tokyo, Japan

[21] Appl. No.: 601,571

[22] Filed: Apr. 18, 1984

[30] Foreign Application Priority Data

Apr. 18, 1983 [JP] Japan ..... 58-68237
May 10, 1983 [JP] Japan ..... 58-81481

[51] Int. Cl.[4] ..... A62C 37/18

[52] U.S. Cl. ..... 169/61; 169/19; 239/579; 239/587

[58] Field of Search ..... 169/61, 56, 60, 19–21; 239/579, 587

[56] References Cited

U.S. PATENT DOCUMENTS 3,047,239 7/1962 Canavan ..... 239/579
3,713,491 1/1973 Grabowski et al. ..... 169/61

FOREIGN PATENT DOCUMENTS 2083746 3/1982 United Kingdom ..... 239/587
2106385 4/1983 United Kingdom ..... 169/61

*Primary Examiner*—Joseph F. Peters, Jr.
*Assistant Examiner*—Daniel R. Edelbrock
*Attorney, Agent, or Firm*—Cushman, Darby & Cushman

[57] ABSTRACT

An automatic fire extinguishing apparatus including a fire sensor, a swivel chamber and an expansible hollow rod secured to the chamber. When a fire is detected by the fire sensor, the swivel chamber is rotated about a vertical axis in accordance with the output of the fire sensor until the rod is directed to the fire source. Then a pressurized fire extinguishing agent contained in a bomb is introduced into the rod through the chamber to expand the rod toward the fire source. The expansion of the rod is stopped when the end of the rod is adjacent the fire source and the free end of the rod is opened, so that the fire extinguishing agent is discharged toward the fire source.

9 Claims, 14 Drawing Figures

APPARATUS FOR AUTOMATICALLY EXTINGUISHING FIRE

BACKGROUND OF THE INVENTION

1. Field of the Invention

This invention relates to an automatic fire extinguishing apparatus installed in a room of a building such as a hotel, a school and a theater to automatically detect a fire and extinguish it.

2. Prior Art

To extinguish a fire in the initial stage, sprinklers or the like have been hitherto employed. However, such a conventional fire extinguishing apparatus having a number of sprinklers is rather expensive. Another drawback of the conventional apparatus is that the fire extinguishing can not be achieved efficiently because the apparatus ejects the extinguishing agent or water from a predetermined position in a predetermined direction and therefore can only extinguish a fire in a restricted area.

SUMMARY OF THE INVENTION

It is therefore an object of the invention to provide an automatic fire extinguishing apparatus which can carry out fire extinguishing operation efficiently and can be manufactured at lower costs.

It is another object of the invention to provide an automatic fire extinguishing apparatus which generates an alarm sound simulating a voice of a man when a fire is detected.

It is a further object of the invention to provide an automatic fire extinguishing apparatus which detects the presence of a person in the room to decide when the fire extinguishing operation should be commenced.

According to the present invention, there is provided an automatic fire extinguishing apparatus which comprises a casing; a bomb (or tank) mounted on the casing and containing a pressurized fire extinguishing agent; a swivel device mounted on the casing for rotation about a generally vertical axis, said swivel device having a chamber in communication with the bomb by a pipe; a valve mounted on the pipe for normally interrupting the communication between the bomb and the chamber; a drive unit mounted on the casing for driving the swivel device in rotation; an axially-expansible hollow rod secured at one end to the swivel device and disposed generally horizontally, the inside of the hollow rod being in communication with the chamber; a closure device normally engaging the free end of the hollow rod to close it; a device for disengaging the closure device from the free end of the hollow rod to open it; a fire sensor mounted on the hollow rod for detecting a fire to output a detecting signal; and a control unit responsive to the detecting signal for actuating the drive unit to rotate the swivel device for moving the hollow rod into a position close to a source of the fire, the control unit being responsive to the detecting signal to open the valve to feed the pressurized fire extinguishing agent to the chamber so that the fire extinguishing agent is fed to the first rod to axially expand it, the control unit responsive to the detecting signal to actuate the disengaging device to open the free end of the hollow rod to discharge the fire extinguishing agent toward the source of fire therefrom.

DESCRIPTION OF THE PREFERRED EMBODIMENTS

Now, the present invention will be described in detail hereunder with reference to the accompanying drawings which illustrate preferred embodiments thereof.

A description will be first made given of a fire extinguishing apparatus provided in accordance with the present invention with reference to FIGS. 1 to 8.

Figure 1:
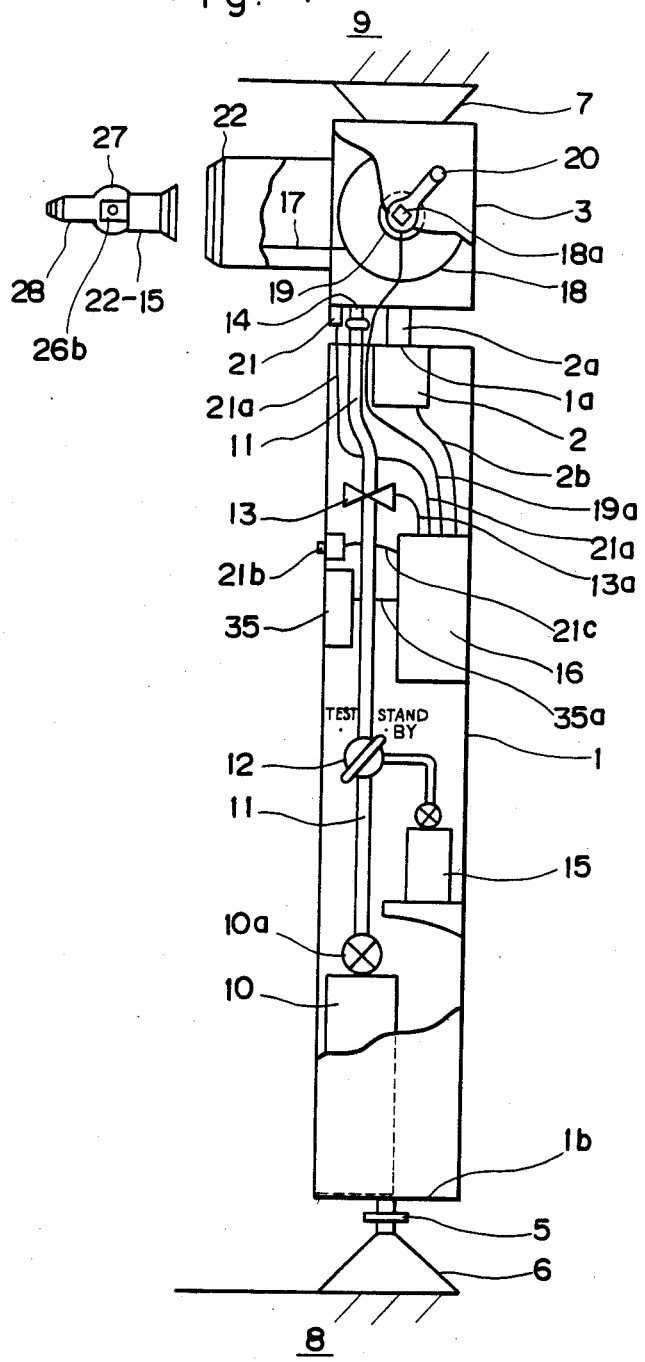
FIG. 1 is a partially sectioned side view of a fire extinguishing apparatus provided in accordance with the present invention.
Figure 2:
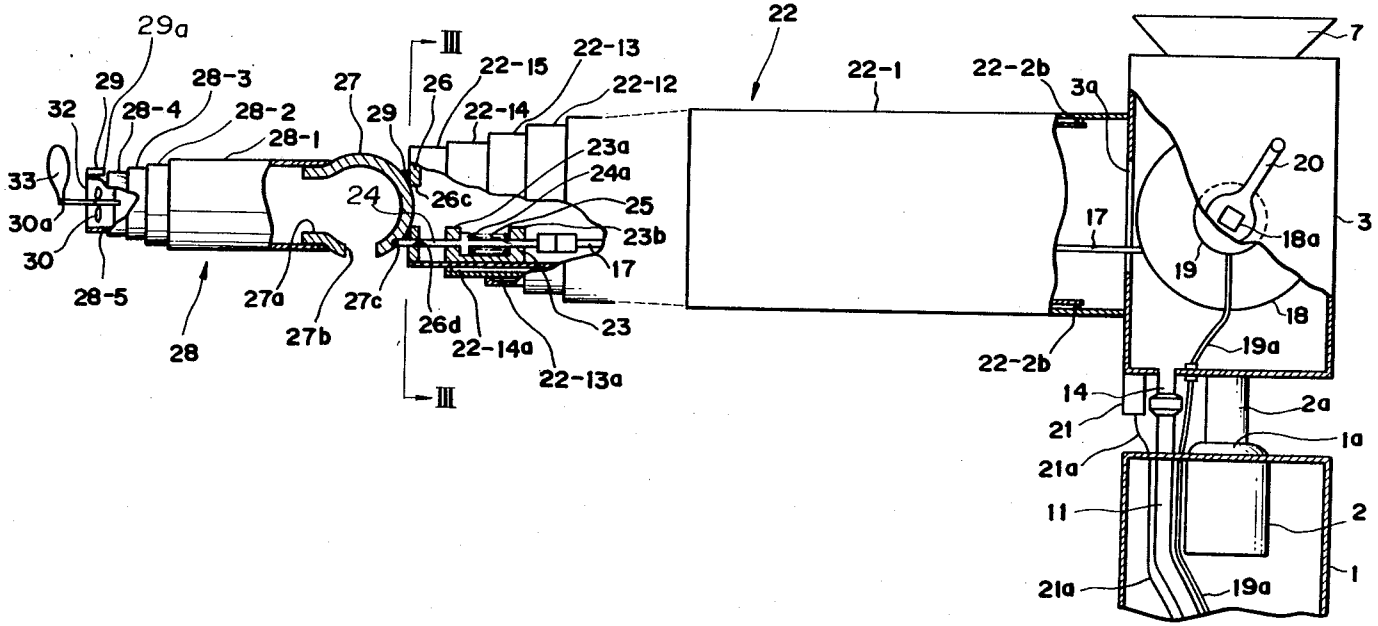
FIG. 2 is a partially sectioned side view illustrating an essential part of the apparatus of FIG. 1 in an enlarged scale.

Among the drawings, FIG. 1 is a partially sectioned side view of the fire extinguishing apparatus, and FIG. 2 is a partially sectioned side view of the apparatus particularly illustrating an essential part of the apparatus in an enlarged scale. In FIGS. 1 and 2 reference numeral 1 designates a cylindrical casing which has a hole 1*a* formed at the central part of the upper surface thereof. An output shaft 2*a* of driving means 2, which comprises a motor and a speed reducing mechanism, is inserted through the hole 1*a* from the bottom so that it fixedly carries a gastight cylindrical swivel chamber 3 at its upper end. The diameter of the chamber 3 is substantially equal to that of the casing 1. Thus, the swivel chamber 3 can swivel about a vertical axis of the casing 1. On the other hand, the casing 1 is provided with a floor fixing pad 6 at its bottom with a height adjusting screw 5 disposed therebetween, and a ceiling fixing pad 7 is rotatably mounted on the swivel chamber 3. Thus, the apparatus is operatively supported in the space as defined between the floor 8 and the ceiling 9 by virtue of the provision of both the fixing pads 6 and 7.

As is apparent from FIG. 1, a fire extinguishing bomb 10 containing therein halogen based fire extinguishing agent is fixedly mounted on the bottom plate 1*b* of the casing 1 and a piping 11 extends upwardly of the outlet valve 10*a* (adapted to be manually operated) of the fire extinguishing bomb 10. The piping 11 serves to establish communication between the fire extinguishing bomb 10 and the swivel chamber 3, and a manually operated switch valve 12 and an electromagnetically operated valve 13 are disposed at the positions located midway of the piping 11. Further, the upper end of the piping 11 is connected to a pipe joint 14 mounted on the bottom of the swivel chamber 3. It should be noted that the piping 11 extending between the electromagnetically operated valve 13 and the pipe joint 14 is made of material having a certain resiliency so as to allow the swivel chamber 3 to swivel without any hindrance. The manually operated switch valve 12 serves to communicate the swivel chamber 3 with the fire extinguishing bomb 10 or a test bomb 15. More specifically, while the manually operated valve 12 is in the "STAND BY" position, the fire extinguishing bomb 10 is in communication with the swivel chamber 3 via the piping 11, whereas while it is the "TEST" position, the test bomb 15 is in communication with the swivel chamber 3 via the piping 11. The electromagnetically operated valve 13 is actuated to open the piping 11 upon detection of an occurrence of fire so that the fire extinguishing agent is supplied to the swivel chamber 3 via the piping 11. The casing 1 is also equipped with a control unit 16 which is fixedly secured to the inner wall at its central part. The control unit 16 will be described later.

The swivel chamber 3 has a reel 18 rotatably secured therein around which a wire 17 is wound, and an electromagnetic brake 19 is arranged on the shaft 18*a* of the reel 18. Further, on the outer peripheral surface of the swivel chamber 3 is provided a handle 20 adapted to manually rotate the shaft 18*a* of the reel 18. Thus, the wire 17 can be wound around the reel 18 by rotating the handle 20. A person sensor 21 for detecting the presence of a person in an area, which is equal to the fire extinguishing area, is attached to the bottom of the swivel chamber 3 at the foremost end part thereof. The person sensor is a pyroelectric type infrared rays sensor and outputs a voltage corresponding to a differentiated value of heat ray radiated from the body of a person. Further, the casing 1 includes a reset switch 21*b* mounted on the outer surface at the upper part thereof. The electromagnetically operated valve 13, the electromagnetic brake 19, the person sensor 21 and the reset switch 21*b* are electrically connected to the control unit 16 via lead wires 13*a*, 19*a*, 21*a* and 21*c*, respectively.

Figure 3:
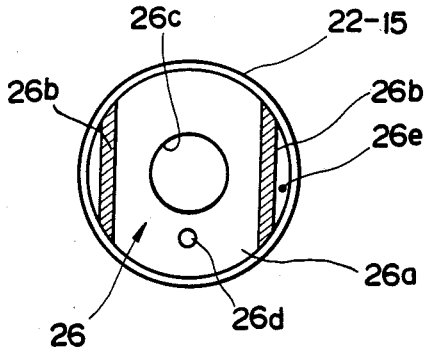
FIG. 3 is a cross-sectional view of the apparatus taken along the line III—III of FIG. 2.
Figure 4:
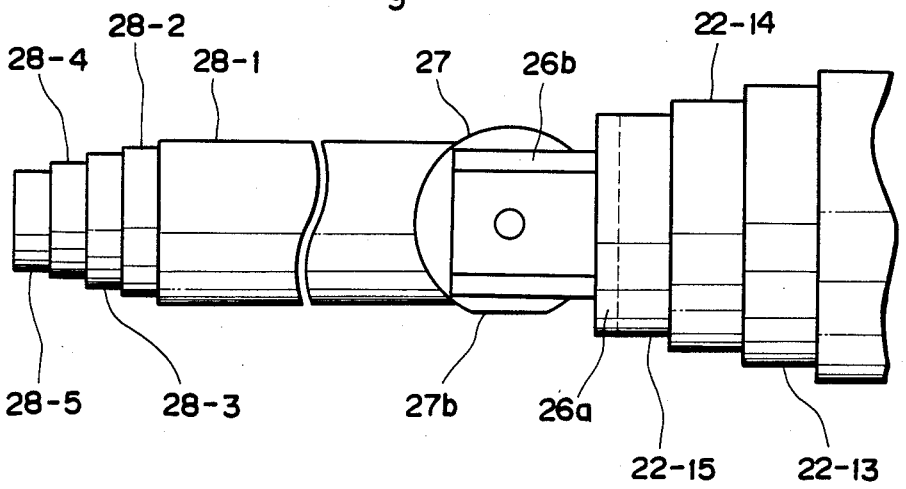
FIG. 4 is a fragmentary side view of the bending section of the rods of the apparatus of FIG. 1.

As illustrated in the drawings, the swivel chamber 3 has a rod 22 extending forwardly of the side wall thereof. Specifically, the rod 22 is constituted by a plurality of telescopic pipes 22-1 to 22-15 which are dimensioned in such a manner that their diameter decreases stepwise from the righthand pipe 22-1 to the lefthand pipe 22-15 as shown in the drawings. It should be noted that the swivel chamber 3 is in communication with the rod 22 via a hole 3*a* formed in the side wall of the former. Each of the pipes 22-1 to 22-15 (22-*i*) is formed with a flange 22-*ia* on the inner surface at the lefthand end thereof with the exception of the pipe 22-15, and each of the pipes 22-1 to 22-15 is fitted with an annular packing 22-*ib* on the outer surface at the righthand end thereof, as shown in the drawing, with the exception of the pipe 22-1. Thus, the pipes 22-1 to 22-15 are slidably fitted to one another without occurrence of substantial leakage. Further, the rod 22 is caused to expand and contract as required without any fear of causing disconnection of one pipe from another. The pipe 22-15 constituting the foremost end part of the rod 22 is fitted with a U-shaped support member 23 on the inner wall at the left end part thereof. Both side walls 23*a* and 23*b* of the member 23 are formed with holes through which a lock rod 24 with a flange 24*a* formed thereon is inserted. An expansive coil spring 25 is mounted on the lock rod 24 in the area as defined between the flange 24*a* and the righthand side wall 23*b* so that the flange 24*a* is normally thrust against the lefthand side wall 23*a*. The right end part of the lock rod 24 is connected to the wire 17 adapted to be wound around the reel 18, whereas the left end part of the rod 24 is projected outwardly through a hole 26*d* formed in the support member 26 which is fixedly fitted to the left end part of the pipe 22-15 (see FIG. 3). As illustrated in FIGS. 3 to 6, the support member 26 is constructed by a combination of a circular base plate 26*a* and an opposing pair of side walls 26*b*, wherein the base plate 26*a* is tightly fitted to the opening at the left end of the pipe 22-15. A hole 26*c* is formed in the central part of the base plate 26*a*, and the hole 26*d* through which the left end part of the lock rod 24 extends is located below the hole 26*c* as shown in FIG. 3. As illustrated in FIGS. 2 to 6, a drum-shaped hollow rotary member 27 is rotatably supported in the space as defined between the side walls 26*b*. On the outer peripheral surface of the rotary member 27 are provided a cylindrical opening 27*a*, a cylindrical opening 27*b* and an axially extending groove 27*c* (see FIGS. 2 and 6). A pipe 28-1 having the largest diameter among a group of pipes 28-1 to 28-5 constituting an axially-expansible rod 28 is tightly fitted onto the cylindrical opening portion 27*a* of the rotary member 27 at the right end thereof. When the left end part of the lock rod 24 is engaged with the groove 27*c* as illustrated in FIG. 2, the rod 22 is in horizontal alignment with the rod 28. It this condition, the hole 26*c* in the support member 26 is closed with the outer peripheral surface of the rotary member 27 with the aid of a packing 29, whereby the rod 22 is kept gastight without any fear of causing leakage. On the other hand, when the lock rod 24 is disengaged from the groove 27*c*, the rod 28 is caused to moved downwardly and expand until it expands at a right angle relative to the rod 22. It this condition, the cylindrical opening 27*b* is in alignment with the hole 26*c*, so that the rod 22 communicates with the rod 28. As a result, fire extinguishing agent discharged from the fire extinguishing bomb 10 is ejected from the pipe 28-5.

Figure 5:
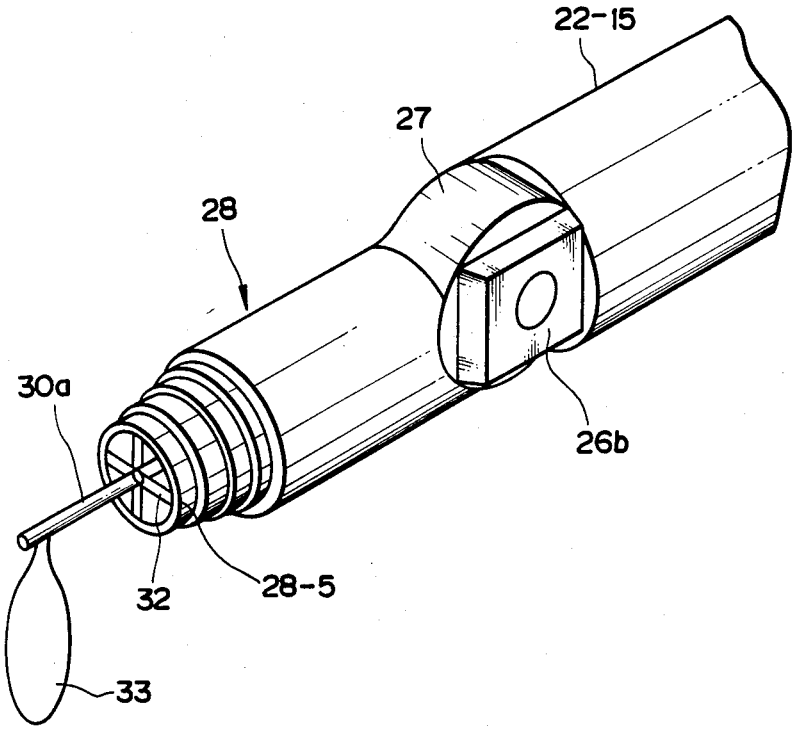
FIG. 5 is a perspective view of the second rod of the apparatus of FIG. 1.
Figure 6:
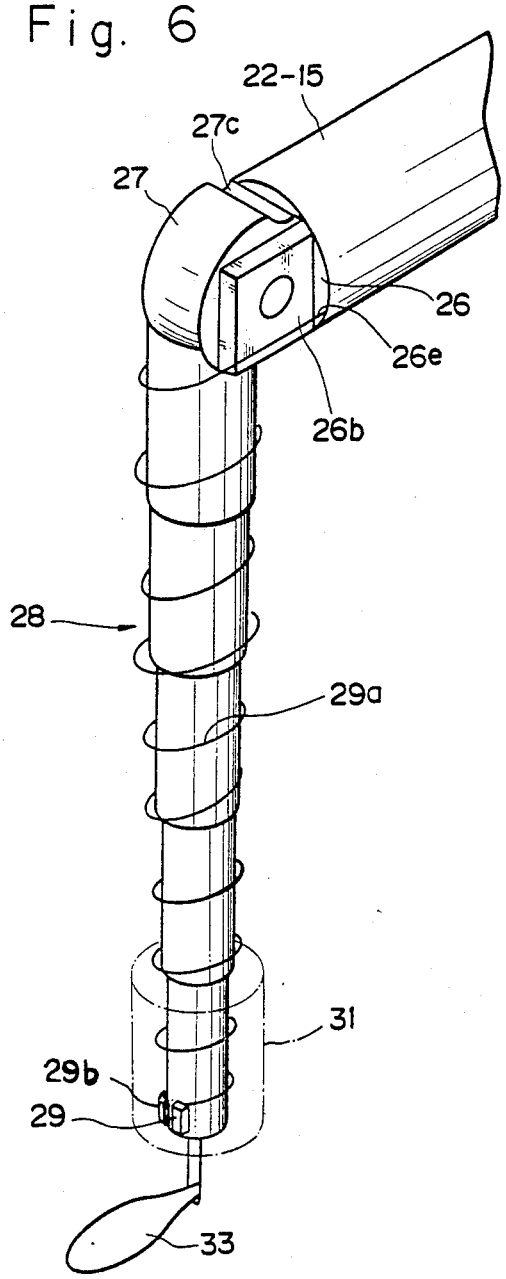
FIG. 6 is a perspective view of the second rod pivoted downwardly at a right angle relative to the first rod.

As illustrated in FIGS. 2 and 6, a heat ray sensor 29 is provided on the outer surface of the pipe 28-5 constituting the foremost end part of the rod 28 and moreover a fan 30 is rotatably arranged in the pipe 28-5. A pyroelectric type infrared ray sensor adapted to output voltage corresponding to a differential value of output of heat ray is typically employed for the heat ray sensor 29. The output signal from the heat ray sensor 29 is transmitted to the control unit 16 as shown in FIG. 1 via a cord 29*a* (see FIG. 6). As is apparent from the drawing, the cord 29*a* is spirally wound around the outer surface of the rod 28 and it is then introduced into the rod 22 through a hole 26*e* formed in the base plate 26*a*. The cord 29*a* then extends along the rod 22 in parallel with the wire 17 and terminates at the control unit 16. It may be understood that the cord 29*a* should be long enough to accommodate the expansion and contraction of both the rods 22 and 28. Alternatively, the cord 29*a* may be a curled cord. The pipe 28-5 constituting the foremost end part of the rod 28 is fitted with a cover 31 surrounding the outer surface thereof as identified by a dot-and-dash line in FIG. 6. When the rod 28 is in its normal position as illustrated in FIGS. 1 to 5, the cover 31 serves to cover the cord 29*a*.

The fan 30 is designed to rotate under the influence of fluid pressure induced when the fire extinguishing agent is discharged outwardly, and it is rotatably supported with the aid of bearing means 32 as illustrated in FIGS. 2 and 5. Further, the fan 30 includes an output shaft 30*a* on which a propeller 33 is fixedly mounted at the position located outwardly of the pipe 28-5. The propeller 33 is intended to disperse the fire extinguishing agent over an area, to which the pipe 28-5 is directed, after it is ejected from the pipe 28-5. It should be noted that the wire 17, the reel 18, the electromagnetic brake 19, the support member 23, the lock rod 24 and the spring 25 constitute a stop and release mechanism, whereas the support member 26 and the rotary member 27 constitute a bend mechanism. In FIG. 1 reference numeral 35 designates an announcing circuit which will be described later.

Figure 7:
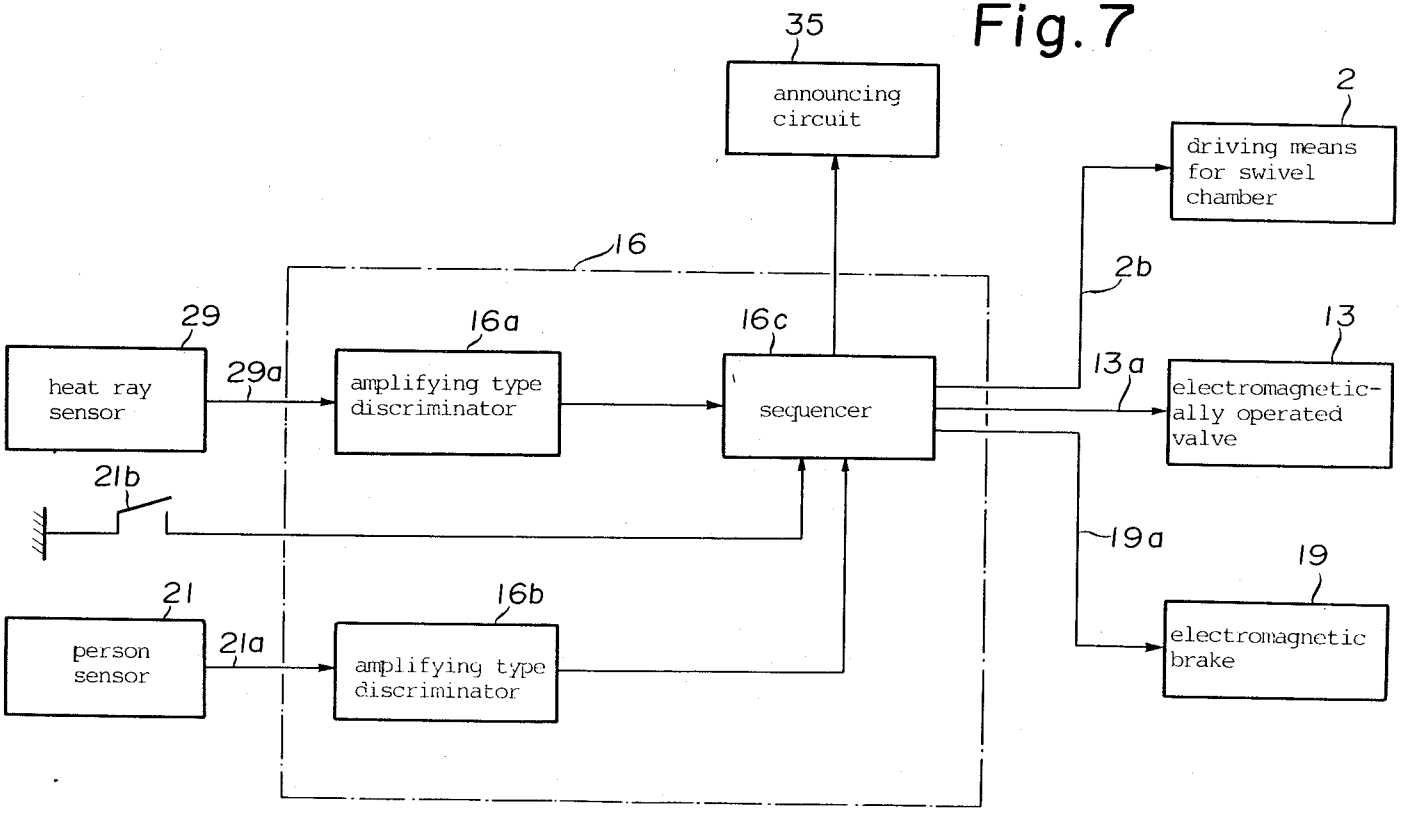
FIG. 7 is a block diagram of the control unit of the apparatus of FIG. 1.

FIG. 7 is a block diagram of a control unit of this apparatus. The same parts or components as those in FIGS. 1 to 6 are identified with same reference numerals in FIG. 7. In the drawing reference numeral 16*a* designates an amplifying type discriminator adapted to output a signal "1" when the heat ray sensor 29 outputs a positive voltage (that is, when the input of heat rays increases) and output a signal "0" when the sensor 29 outputs a voltages equal to zero or a negative voltage. Further, reference numeral 16*b* designates another amplifying type discriminator having a SR flip-flop (hereinafter referred to simply as FF) which is not shown in the drawing. It should be noted that when the output voltage transmitted from the person sensor 21 is positive, the FF is set and when the output voltage is negative, the FF is reset. Thus, the amplifying type discriminator 16*b* outputs a signal "1" when any person stays in the room and the discriminator 16*b* outputs a signal "0" when no person stays there. Reference numeral 16*c* designates a sequencer which serves to turn on or off the swivel chamber driving means 2, the electromagnetically operated valve 13 and the electromagnetic brake 19 in response to the outputs of the amplifying type discriminators 16*a* and 16*b*, and the sequencer 16*c* moreover initiates activation of the announcing circuit 35. Specifically, the announcing circuit 35 is designed to output an alarm call such as "fire, fire" and "fire extinguishing will start". Incidentally, the above-described components 16*a* to 16*c* constitute the control unit 16. The reset switch 21*b* is actuated when the sequencer 16*c* should be reset to interrupt fire extinguishing. A description will be given later as to how to operate the reset switch 21*b*.

Now, the operation of this apparatus will be described hereinafter. The apparatus may operate in either one of two modes, i.e., in a fire extinguishing mode (where the manually operated switch valve 12 is in the "STAND BY" position) or in a test mode (where the manually operated switch valve 12 is in the "TEST" position).

Figure 8:
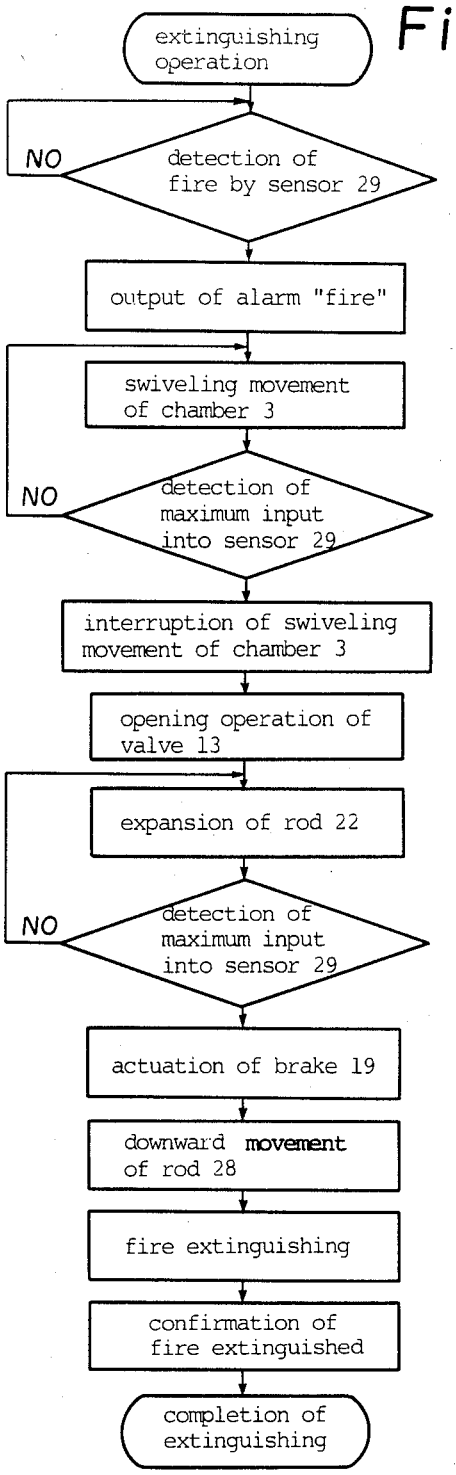
FIG. 8 is a flow chart of the fire extinguishing operations of the apparatus of FIG. 1.

First, a description will be given as to the fire extinguishing mode. In this case, the outlet valve 10*a* of the fire extinguishing bomb 10 is opened, but the fire extinguishing agent introduced into the piping 11 is interrupted by the electromagnetically operated valve 13. And it is assumed that the swivel chamber 3 has fully swiveled clockwise so that it can only swivel counterclockwise. Moreover, it is assumed that no person stays in the room and the amplifying type discriminator 16*b* outputs a signal "0". When an occurrence of fire is detected by the heat ray sensor 29 under the condition of assumptions as mentioned above, the output voltage of the sensor increases and a signal "1" is transmitted from the amplifying type discriminator 16*a* to the sequencer 16*c*. Thus, the sequencer 16*c* actuates the announcing circuit 35 and swivel chamber driving means 2 so that an alarm call "fire, fire! fire extinguishing will start soon!" is generated by the announcing circuit 35 and the swivel chamber 3 starts to swivel counterclockwise. When the output signal of the amplifying type discriminator 16*a* varies from "1" to "0", that is, when the input of heat rays into the heat ray sensor 29 reaches the highest level, the sequencer 16*c* stops the operation of the driving means 2, so that the rods 22 and 28 of the swivel chamber 3 are pointed to the fire source. Next, the sequencer 16*c* actuates the electromagnetically operated valve 13. This causes the fire extinguishing agent to be delivered to the rod 22 via the electromagnetically operated valve 13 and swivel chamber 3. At this moment however the hole 26*c* at the foremost end of the rod 22 is closed off by the rotary member 27, so that the swivel chamber 3 and rod 22 are still kept gastight without any occurrence of leakage. Thus, the rod 22 is caused to extend under the influence of pressure of the fire extinguishing agent. As the rod 22 expands, the wire 17 is pulled out of the reel 18 by the lock rod 24 at the foremost end part of the rod 22 in which case the reel 18 is rotated clockwise. Next, when the output signal of the amplifying type discriminator 16*a* changes its state from "1" to "0", that is, when the input of heat rays into the heat ray sensor 29 reaches the highest level, the sequencer 16*c* actuates the electromagnetic brake 19. This causes the reel 18 to be braked, so that the wire 17 is tightly stretched in the area as defined between the reel 18 and the support member 23. As a result, the lock rod 24 is pulled to the right against the resilient force of the spring 25. Consequently, the rod 22 stops its expansion and the lock rod 24 is disengaged from the groove 27*c*, so that the rod 28 is pivoted downwardly. At this moment, the cylindrical opening 27*b* is in alignment with the hole 26*c*, so that the rod 22 communicates with the rod 28 and therefore the fire extinguishing agent is ejected from the foremost end of the rod 28. As the agent is ejected, the fan 30 is rotated together with the propeller 33, so that it is positively dispersed over the area to which the rod 28 is directed. And when the fire extinguishing is completed with success, the input of heat rays into the heat ray sensor 29 decreases gradually until it outputs a negative voltage. Thus, the amplifying type discriminator 16*a* outputs signal "0" whereby the sequencer 16*c* can confirm the completion of the fire extinguishing. Incidentally, FIG. 8 is a flow chart in the form of a block diagram schematically illustrating the steps of the operations of fire extinguishing as described above.

Next, a description will be given as to the case where a person stays in the room and therefore the amplifying type discriminator 16*b* outputs signal "1".

When an occurrence of fire is detected, the sequencer 16*c* first actuates the announcing circuit 35 to output an alarm call "fire! fire!". And in the case where the reset switch 21*b* fails to be depressed within a predetermined period of time (for instance, 10 seconds) after the detection of fire the above-described steps of operations of fire extinguishing are performed. If the reset switch 21*b* is depressed within the predetermined period of time, the sequencer 16c and announcing circuit 35 are reset to interrupt the fire extinguishing operation.

Next, a description will be given as to the operation in the test mode. In this case, an inspector mounts the test bomb 15 in the apparatus and connects it to the piping 11, thereafter the inspector sets the manually operated switch valve 12 to the "TEST" position to establish communication between the test bomb 15 and the piping 11, as illustrated in FIG. 1. Test fire is produced at a proper location in the room so that the above-described steps of operation of fire extinguishing are carried out, this enables the inspector to confirm whether the apparatus of the invention properly operates or not.

When all the steps of operations of fire extinguishing are completed, an operator undertakes the subsequent operations. Namely, he handles the rod 28 so as to resume the original position (where the rod 28 is in alignment with the rod 22) and then rotates the handle 20 to contract the rod 22. After the rods 22 and 28 resume the original position as illustrated in FIGS. 1 and 2, the bomb 10 is replaced with a new one.

As shown in FIG. 6 another heat ray sensor 29b may be additionally provided, in this case the sensor 29b and the sensor 29 are mounted on the rod 28-5 in juxtaposed relation. By virtue of the provision of these sensors, more precise positioning of the rods 22 and 28 to the fire source can be achieved by detecting a point at which both outputs of the sensors 29 and 29b become equal to each other.

Next, a description will be given as to a modified fire extinguishing apparatus with reference to FIGS. 9 to 14.

Figure 9:
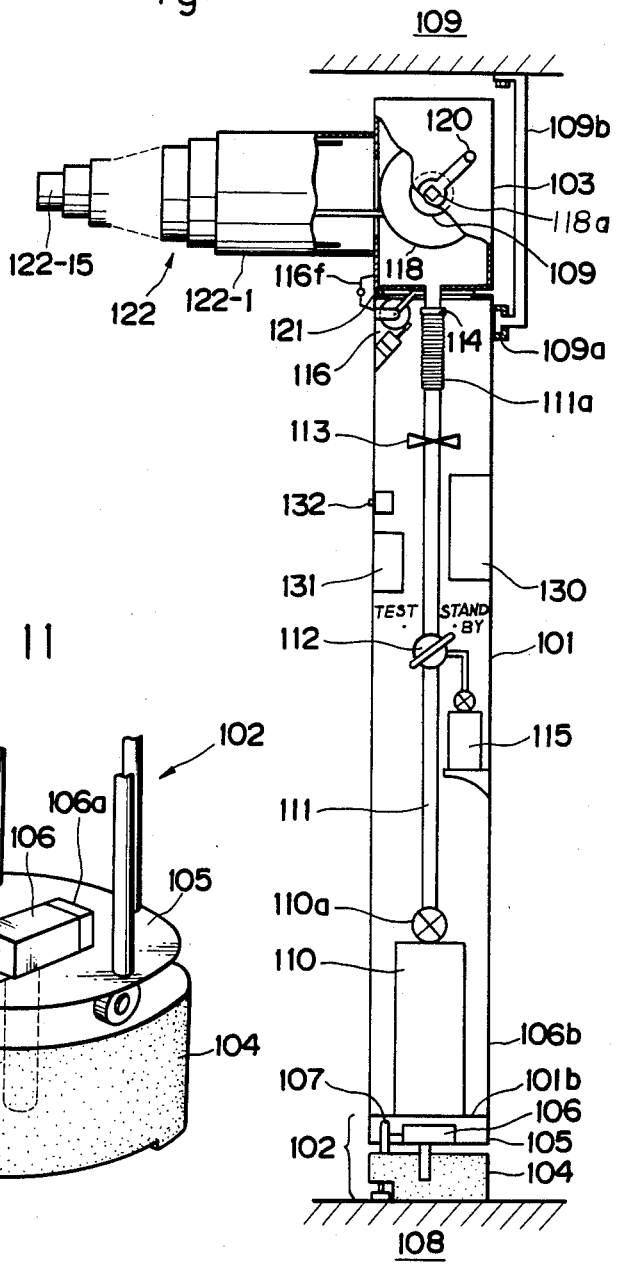
FIG. 9 is a partially sectioned side view of a modified fire extinguishing apparatus.
Figure 11:
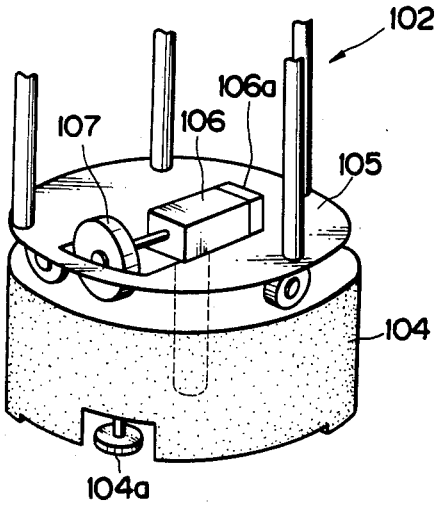
FIG. 11 is a perspective view of the bottom section of the apparatus of FIG. 9.
Figure 10:
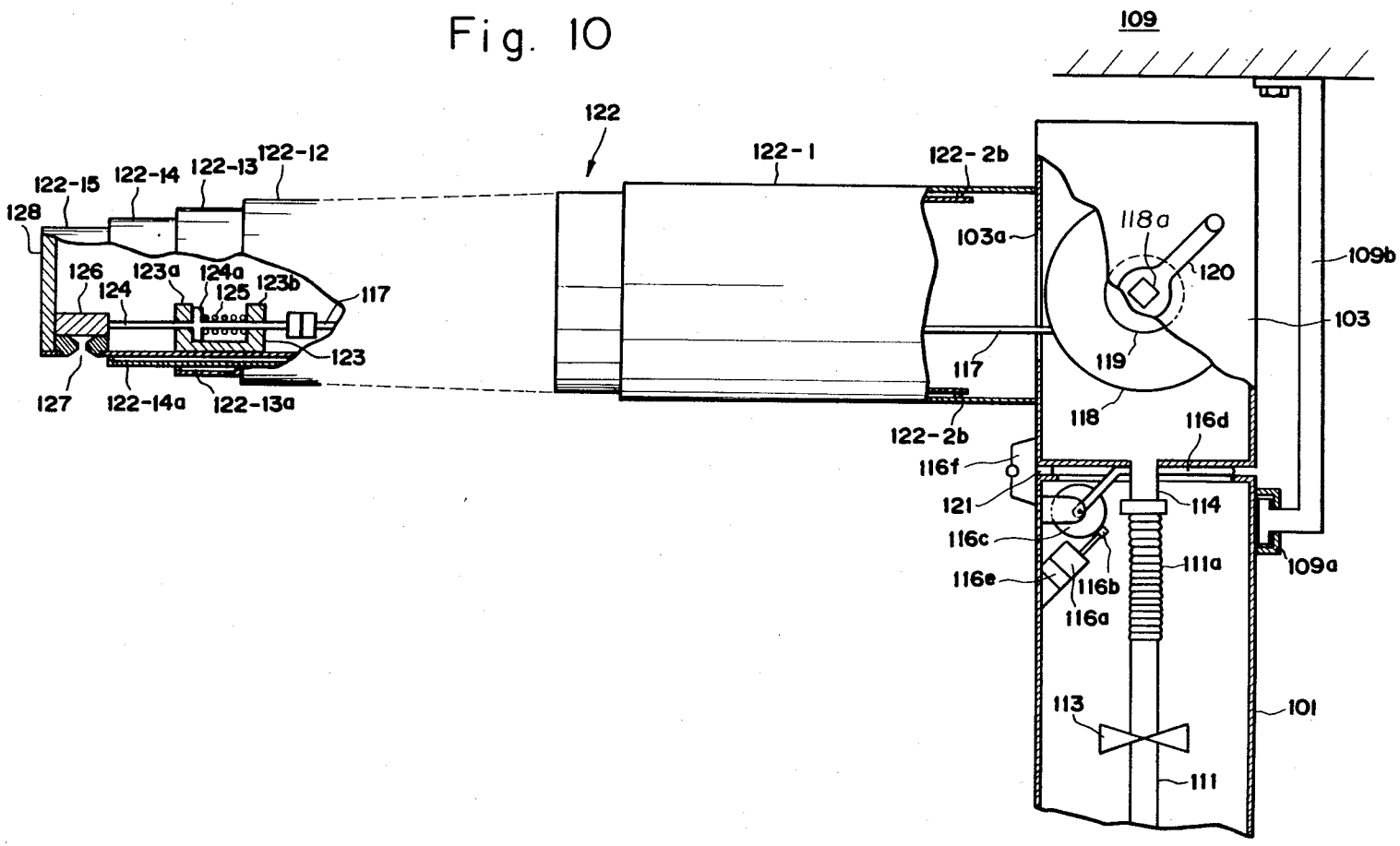
FIG. 10 is a partially sectioned side view illustrating an essential part of the apparatus of FIG. 9.

Among the drawings, FIG. 9 is a partially sectioned side view of the apparatus schematically illustrating how it is constructed, and FIG. 10 is a partially sectioned side view of the apparatus particularly illustrating an essential part of the apparatus in an enlarged scale. In the drawings, reference numeral 101 designates a cylindrical casing. Mounted on a bottom plate 101b of the casing 101 is a drive assembly 102 for rotating the casing 101, and on the top end of the casing 101 a swivel chamber 103 is mounted. As best shown in FIG. 11, the drive assembly 102 essentially comprises a stationary stand 104 made of concrete or the like, a rotatable platform 105 and driving means 106 which is constructed by a combination of a motor and a speed reducing mechanism. The driving means 106 includes a wheel 107 adapted to roll on the stationary stand 104 to thereby rotate the platform 105. The number of revolutions of the driving means 106 is detected by a rotation detector 106a. Further, the stationary stand 104 has at its bottom an adjusting bolt 104a for adjusting its level. On the other hand, the casing 101 is provided with a guide 109a on the rear surface which is slidably fitted onto the lowermost end part of a support member 109b depending from the ceiling 109. Thus, the casing 101 and the swivel chamber 103 are caused to swivel together about a vertical axis by the driving assembly 102.

A fire extinguishing bomb 110 containing therein halogen gas based fire extinguishing agent is firmly mounted on the bottom plate 101b in the casing 101. The fire extinguishing bomb 110 (hereinafter referred to simply as bomb) has an outlet valve 110a from which a piping 111 extends upwardly. The piping 111 serves to establish communication between the bomb 110 and the swivel chamber 103, and a manually operated switch valve 112 and an electromagnetically operated valve 113 are disposed at the positions located midway of the piping 111. As is apparent from FIG. 9, the upper position of the piping 111 between the electromagnetically operated valve 113 and the pipe joint 114 is constituted by a flexible pipe 111a which allows the swivel chamber 103 to tilt without any hindrance. The manually operated switch valve 112 serves to communicate the swivel chamber 103 with the bomb 110 or the test bomb 115. Specifically, when the manually operated valve 112 is in the "STAND BY" position, the bomb 110 is in communication with the swivel chamber 103 via the piping 111, whereas when the valve 112 is in the "TEST" position, the test bomb 115 is in communication with the swivel chamber 103 via the piping 115. The electromagnetically operated valve 113 opens to deliver the fire extinguishing agent discharged from the bomb 110 to the swivel chamber 103 immediately after an occurrence of fire is detected. Further, on the upper end part of the casing 101 is arranged a tilting mechanism 116 which comprises a reversible motor 116a, a worm 116b fixedly mounted on an output shaft of the reversible motor 116b, an arm 116d fixedly secured to the worm wheel 116c and a rotation detector 116e for detecting the number of revolutions of the motor 116a, the arm 116d having an inverted V-shaped cross-sectional configuration. Since the arm 116d is located at the bottom of the swivel chamber 103, the chamber 103 is caused to tilt up and down about the axis of a pin constituting the hinge 116f when the motor 116a is actuated.

A reel 118 with a wire 117 wound therearound is rotatably secured in the swivel chamber 103 and a rotary encoder 118b (see FIG. 13) and an electromagnetic brake 119 are mounted on a shaft 118a of the reel 118. Incidentally, the rotary encoder 118b serves to detect an amount of rotation of the reel 118. A handle 120 for manually rotating the shaft 118a is disposed outside the swivel chamber 103 so that the wire 117 can be wound around the reel 118 by operating the handle 120. Further, the swivel chamber 103 is equipped with a person sensor 121 at the foremost end part of the bottom which detects a person in an area equal to a fire extinguishing area covered by the apparatus. The person sensor 121 is, for example, a pyroelectric type infrared ray sensor which outputs a voltage corresponding to a differentiated value of heat rays radiated from the body of a person.

As illustrated in the drawings, the swivel chamber 103 has a rod 122 extending forwardly of the side wall thereof. Specifically, the rod 122 is constructed by a plurality of telescopic pipes 122-1 to 122-15 which are dimensioned in such a manner that their diameter decreases stepwise from the righthand pipe 122-1 to the lefthand pipe 122-15 as shown in the drawings. The swivel chamber 103 is in communication with the rod 122 via a hole 103a formed in the side wall of the swivel chamber 103. Each of the pipes **122-*i* (i=1 to 14) is formed with a flange 122-*ia* on the inner surface at the lefthand end thereof with the exception of the pipe 122-15, and moreover each of the pipes 122-*i* (i=2 to 15) is fitted with an annular packing 122-*ib* on the outer surface at the righthand end thereof, as shown in the drawings, with the exception of the pipe 122-1. Thus, the pipes 122-1 to 122-15 are slidably fitted to one another without any occurrence of leakage. Therefore, the rod 122 is caused to expand and contract as required without any fear of causing disconnection of the pipes from one another. The pipe 122-15 is fitted with a U-shaped support member 123 on the inner wall at the position located in the proximity of the left end thereof. Side walls 123a and 123b of the support member 123 are formed with holes through which a rod 124 having a flange 124a formed thereon is inserted. An expansive coil spring 125 is mounted on the rod 124 between the flange 124a and the righthand side wall 123b so that the flange 124a is normally thrust against the lefthand side wall 123a. The right end part of the rod 124 is connected to the wire 117 adapted to be wound around the reel 118, whereas the left end part of the same is connected to an opening and closing member 126. As best shown in FIG. 10, the opening and closing member 126 is slidably mounted on a nozzle 127 fixedly secured to the inner wall of the pipe 122-15 at the lower left end thereof. Specifically, when the flange 124a is thrust against the lefthand side wall 123a under the influence of the resilient force of spring 125, the nozzle 127 is closed with the opening and closing member 126, so that the pipe 122-15 is kept gastight without any occurrence of leakage. On the other hand, when the wire 117 is pulled to the right to thereby displace the opening and closing member 126 to the right, the nozzle 127 is opened and the fire extinguishing agent is ejected outwardly through the nozzle 127. It should be noted that the pipe 122-15 is tightly fitted with a plug 128 at the foremost end thereof. Incidentally, in FIG. 9 reference numeral 130 designates a control unit, reference numeral 131 designates an announcing circuit and reference numeral 132 designates a reset switch which will be described later. The driving means 106, the rotation detectors 106a, 116e, the electromagnetically operated valve 113, the motor 116a, the rotary encoder 118b, the electromagnetic brake 119, the person sensor 121 and the reset switch 132 are electrically connected to a control unit 130 via connecting cords (see FIG. 13**).

Figure 12:
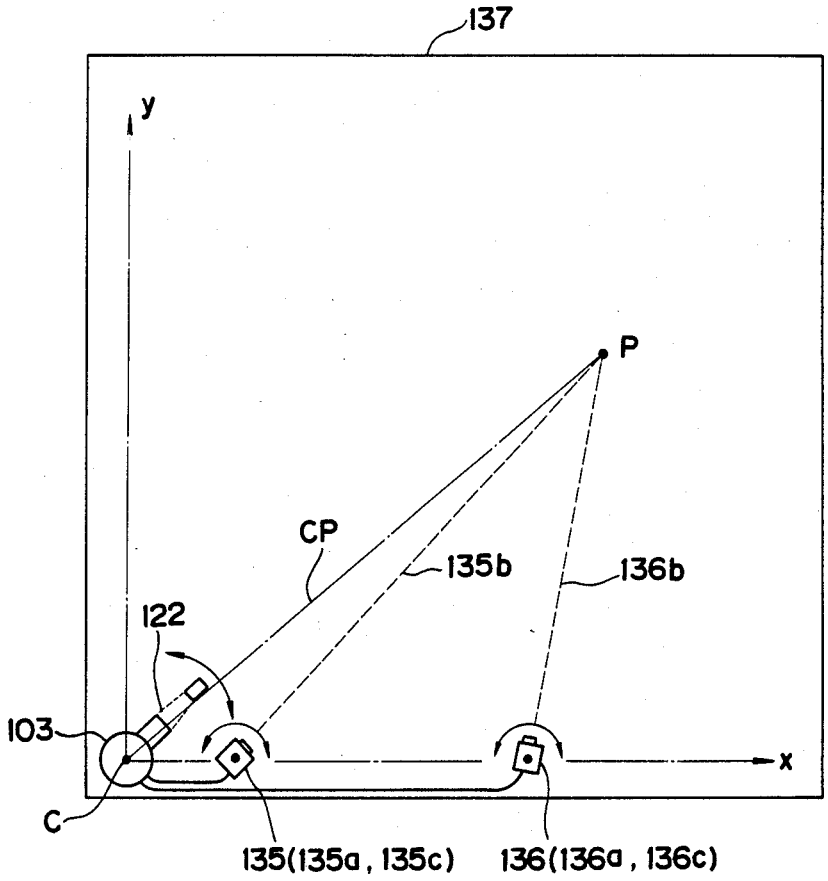
FIG. 12 is a plan view schematically illustrating where the body of the apparatus, the fire sensors and a fire source are located in the room.

FIG. 12 is a plan view which illustrates where the apparatus and fire sensors 135 and 136 are located in a room. As illustrated in the drawing, the apparatus is disposed at one corner of a room 137. Both the fire sensors 135 and 136 are arranged at elevated positions in the room 137 where the floor 108 can be looked down upon. It should be noted that the fire sensor 135 (136) is constructed of an optical system including lenses, a detecting element for detecting flame by sensing infrared rays received through the optical system, a vertically extending slit formed in the foremost end part of the optical system and a panning apparatus 135a (136a) (see FIG. 13) for turning the whole assembly about a vertical axis thereof. The fire sensor 135 always pans and monitors the images of the room received through the slit to detect a fire or a flame. And the direction of the fire source is detected by inputting the output of a rotary encoder 135c, which is operatively connected to the panning apparatus 135a, when the fire source is disposed in a vertical plane 135b extending through the slit and the detecting element (see FIG. 13). The vertical plane 135b is identified by a dotted line in the drawing. On the other hand, the fire sensor 136 is adapted to start its panning operation to detect a fire only after an occurrence of fire is first detected by the fire sensor 135. The direction of the fire source is detected by inputting the output of a rotary encoder 136c when the fire source is disposed in a vertical plane 136b extending through the slit and the detecting element of the fire sensor 136. The vertical plane 136b is identified by a dotted line in FIG. 12. Thus, the direction to which the rod 122 should be directed can be determined with reference to a line segment CP which extends between a point P (hereinafter referred to as a fire source P) and the center C of the swivel chamber 103, the point P being located on a vertical line extending along the intersection of both the vertical planes 135b and 136b. Incidentally, it is assumed that any flame has a height of about 1.5 m as measured from the floor 108.

Figure 13:
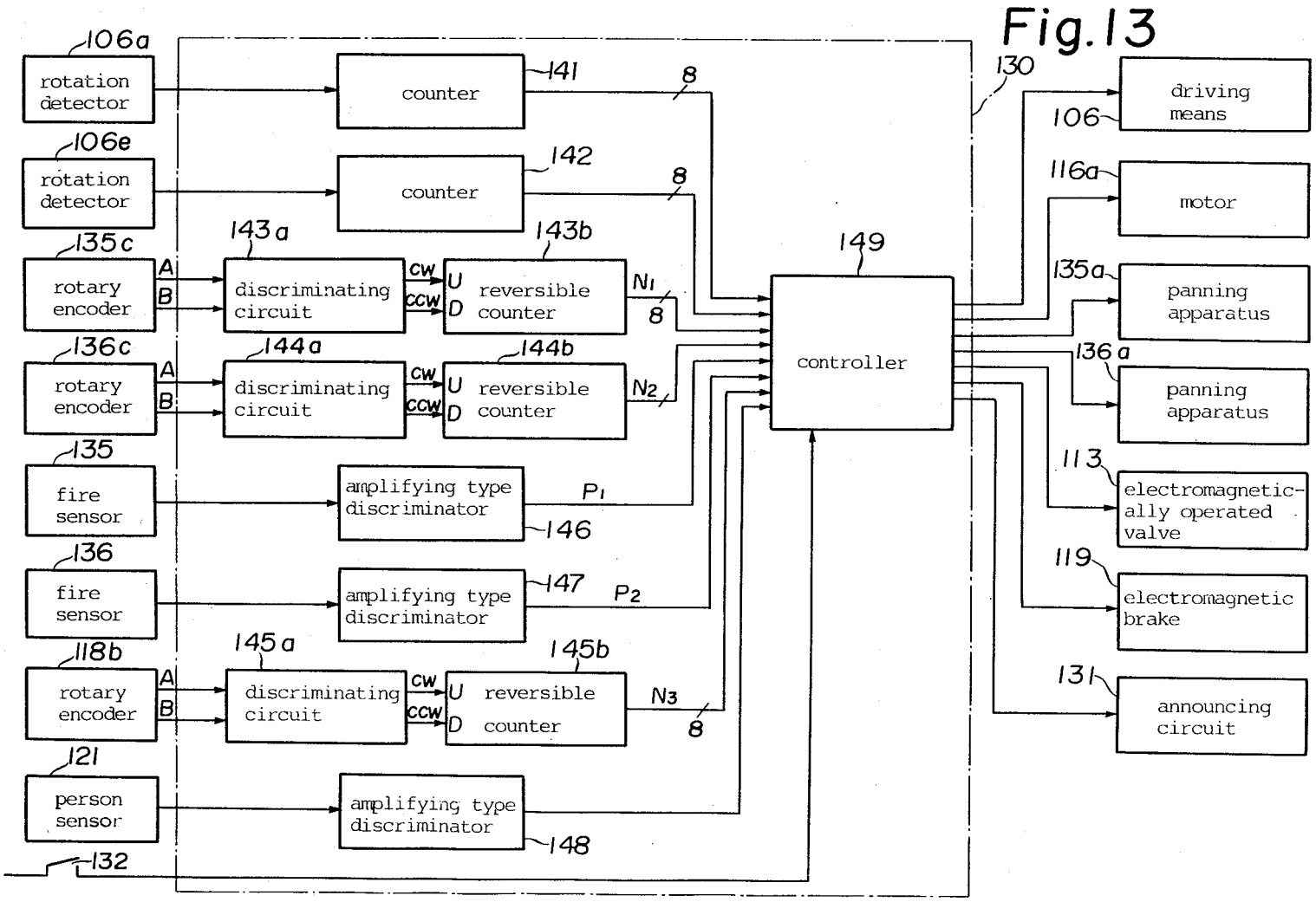
FIG. 13 is a block diagram of the control unit of the apparatus of FIG. 9.

FIG. 13 is a block diagram schematically illustrating how the control unit 130 of this apparatus is constructed. In the drawing, reference numerals 141 and 142 designate counters for counting pulses outputted from the rotation detectors 106a and 116e. The number of pulses outputted from the rotation detector 106a corresponds to the number of revolutions of the driving means 106 and the number of pulses outputted from the rotation detector 106e corresponds to the number of revolution of the motor 116a. Discriminating circuits 143a, 144a and 145a output a series of pulses CW and CCW in response to a series of pulses A and B transmitted from the rotary encoders 135c, 136c and 118b, respectively, and reversible counters 143b, 144b and 145b count up the series of pulses CW and count down the series of pulses CCW. Each of the above-mentioned components is well known in the art. Specifically, the reversible counters 143b and 144b output the value of counts $N_1$ and $N_2$ corresponding to the rotational positions of the fire sensors 135 and 136 (strictly speaking, the direction of extension of the vertical planes 135b and 136b), whereas the reversible counter 145b outputs the value of counts $N_3$ corresponding to the extent of rotation of the reel 118. Next, reference numerals 146 and 147 designate amplifying type discriminators. The discriminator 146 outputs a signal "1" when the fire sensor 135 detects an occurrence of fire and outputs a signal "0" when the sensor detects no fire. The discriminator 147 operates in a manner described for the discriminator 146. Specifically, the amplifying type discriminators 146 and 147 output pulses $P_1$ and $P_2$ each having a width corresponding to the size of fire source P. Further, reference numeral 148 designates an amplifying type discriminator adapted to output signal "1" when the person sensor 121 detects the existence of a person and to output signal "0" when it does not. Reference numeral 149 designates a controller which includes processing means for calculating the direction and length of line segment CP which is determined by the position of fire source P with reference to the values of counts $N_1$ and $N_2$. The controller 149 also includes sequence controlling means for carrying out control operations with reference to the direction and length of the line segment CP. Thus, the above-described components 141, 142, 143a to 145a, 143b to 145b and 146 to 149 constitute the control unit 130. An announcing circuit 131 outputs an alarm call such as "fire! fire!", "fire extinguishing will start soon'". A reset switch 132 is used when the controller 149 should be reset to interrupt a fire extinguishing operation. A description will be given later as to the timing when the rest switch 132 should be actuated.

Now, the operation of this modified apparatus will be described hereinafter. This apparatus operates in either one of two modes, i.e., in a fire extinguishing mode (where the manually operated switch valve 112 is in the "STAND BY" position) or in a test mode (where the manually operated switch valve 112 is in the "TEST" position).

First, a description will be given as to the fire extinguishing mode. In this case, the outlet valve 110a of the fire extinguishing bomb 110 is opened, but the fire extinguishing agent introduced into the piping 111 is interrupted by the electromagnetically operated valve 113. And it is assumed that the swivel chamber 103 has fully swiveled clockwise so that it can only swivel counterclockwise. Moreover, it is assumed that no person stays in the room and the amplifying type discriminator 148 outputs a signal "0". Moreover, it is assumed that each of the counters 141, 142, 143*b*, 144*b* and 145*b* is cleared (clearing is effected by depressing the reset switch 132). While these components are maintained in the above-mentioned operating conditions, the controller 149 drives the panning apparatus 135*a*, and the fire sensor 135 is brought into panning operation (rotational movement about a vertical axis thereof). The rotational position of the fire sensor 135 is detected with reference to the value of counts $N_1$ counted by the reversible counter 143*b*.

Figure 14:
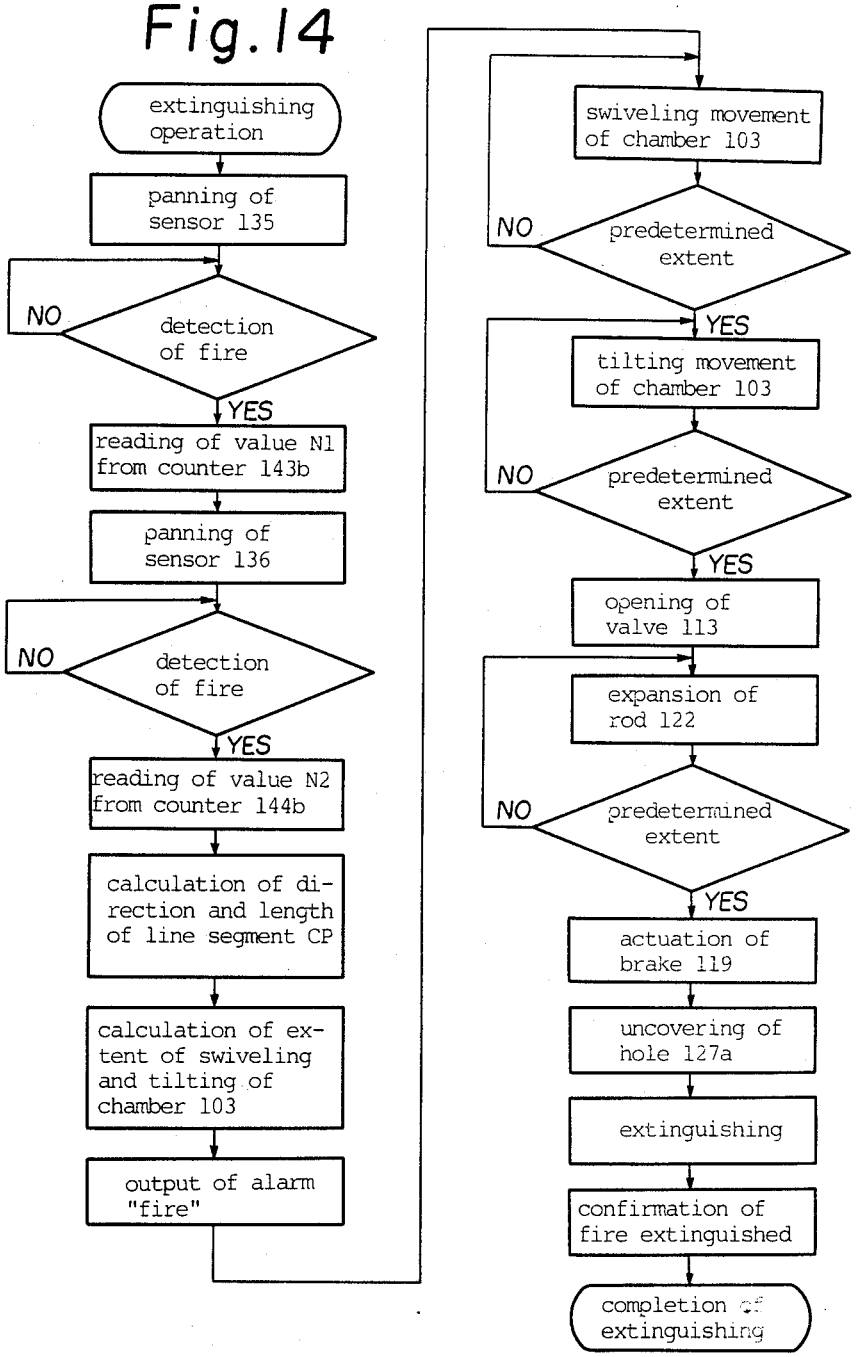
FIG. 14 is a flow chart of the operations of the apparatus of FIG. 9.

When the fire sensor 135 detects an occurrence of fire, pulses $P_1$ are outputted from the amplifying discriminator 146, and the value of counts $N_1$ outputted from the counter 143*b* is read into the controller 149. The controller 149 actuates the panning apparatus 136*a* and causes the fire sensor 136 to start its panning operation. Then, when the fire sensor 136 detects the fire, pulses $P_2$ are outputted from the amplifying type discriminator 147 and the value of counts $N_2$ counted by the reversible counter 144*b* is read into the controller 149. Next, the controller 149 calculates the location of the fire source P with reference to the position of the intersection line of the vertical planes 135*b* and 136*b* which are derived from the values of counts $N_1$ and $N_2$, and then calculates the direction and length of the line segment CP. Thereafter, the extent of swiveling of the swivel chamber 103, the extent of tilting of the same and the length of expansion or contraction of the rod 122 are determined with reference to the direction and length of the line segment CP. The controller 149 then actuates the announcing circuit 131 to output an alarm call "fire! fire! fire extinguishing will start soon!". Further, the controller 149 actuates the driving means 106 in the drive assembly 102 to cause the casing 101 to rotate. This causes the swivel chamber 103 to swivel together with the casing 101. At this moment the number of revolutions of the driving means 106 is detected by the rotation detector 106*a* and it is then counted by the counter 141. When the value of counts counted by the counter 141 reaches the value corresponding to the extent of swiveling of the swivel chamber 103 as calculated in the above-described manner, the controller 149 interrupts the operation of the driving means 106, and then the motor 116*a* in the tilting mechanism 116 is caused to rotate. The rotation of the motor 116*a* is detected by the rotation detector 116*e* and the number of revolutions thereof is counted by the counter 142. When the value of counts counted by the counter 142 reaches the value corresponding to the extent of tilting of the swivel chamber 103 as calculated in the above-described manner, the controller 149 interrupts the operation of the motor 116*a*. Thus, the swivel chamber 103 is caused to swivel and tilt so as to be directed to the fire source P. Next, the controller 149 actuates the electromagnetically operated valve 113 so that the fire extinguishing agent is delivered to the rod 122 via the swivel chamber 103. At this moment however the nozzle 127 disposed at the foremost end of the rod 122 is kept closed with the opening and closing member 126 and therefore the swivel chamber 103 and the rod 122 are maintained gastight. Thus, the rod 122 is caused to expand under the influence of the pressure of the fire extinguishing agent. The wire 117 is then pulled by the rod 124 at the foremost end of the rod 122 so that it is unreeled from the reel 118. This causes the reel 118 to rotate clockwise. The rotation of the reel 118 is detected by the rotary encoder 118*b* and the number of pulses outputted therefrom is counted by the reversible counter 145*b*. When the value of counts $N_3$ counted by the latter reaches the value corresponding to the extent of expansion of the rod 122 as calculated in the above-described manner, the controller 149 actuates the electromagnetic brake 119. This causes the reel 118 to be braked, so that the wire 117 is tightly stretched in the area as defined between the reel 118 and the support member 123. As a result, the rod 124 is displaced to the right against resilient force of the spring 125. Consequently, the rod 122 stops its expansion and the opening and closing member 126 is displaced to the right which causes the nozzle 127 to be opened, so that the fire extinguishing agent is ejected outwardly through the nozzle 127. At this moment, the rod 122 is pivotally moved downwardly with the swivel chamber 103 tilted at a certain downward inclination until the nozzle 127 is directed to the predetermined position whose height is about 1.5 m as measured from the floor 108. Thus, effective fire extinguishing is achieved by the ejection of the fire extinguishing agent. When the fire extinguishing is completed with success, no detection signal is outputted from both the fire sensors 135 and 136 and therefore the amplifying type discriminators 146 and 147 do not output pulses $P_1$ and $P_2$. This allows the controller 149 to confirm that the fire extinguishing has been completed. Incidentally, FIG. 14 is a flow chart in the form of a block diagram schematically illustrating the steps of operations of the fire extinguishing as described above.

Next, a description will be given as to the case where a person stays in the room, i.e., the case where the amplifying type discriminator 148 outputs signal "1". When an occurrence of fire is detected, the controller 149 first actuates the announcing circuit 131 to output an alarm call "fire! fire!". If the reset switch 132 fails to be depressed within a predetermined period of time (for instance, 10 seconds) after the detection of fire, the above-described steps of operations of fire extinguishing are initiated. On the other hand, when the switch 132 is depressed within the predetermined period of time, the controller 149 and the announcing circuit 131 are reset so that no fire extinguishing operation is performed.

Next, a description will be given as to the operation in the test mode mode. In this case, an inspector sets the manually operated switch valve 112 to the "TEST" position to connect the test bomb 115, as illustrated in FIG. 9, to the piping 11. A test fire is produced at a properly determined location in the room so that the above-described steps of operations of fire extinguishing are initiated. This enables the inspector to confirm whether the apparatus properly operates or not.

When all the steps of fire extinguishing are completed, an operator undertakes subsequent operations. Namely, he contracts the rod 122 by rotating the handle 120 and allows the driving means 106 and the motor 116*a* to rotate in the reverse direction (reverse rotation is effected by actuating a manually operated switch which is not shown in the drawings) until the rod 122 resumes the original position as illustrated in FIGS. 9 and 10. Thereafter, the bomb 110 is replaced with a new one.

It should be noted that the present invention may be embodied in the different manner from the above-described embodiments. For instance, an apparatus according to the present invention may be electrically connected to a signal transmitting unit which serves to transmit signals indicating any abnormality to a control center located remote from the apparatus so that a signal indicating an occurrence of fire is transmitted to the control center when a fire is detected by the heat ray sensor. Further, the person sensor may detect an unauthorized person being in the room and the apparatus can inform the control center. This will contribute to the prevention of crimes.

In the above-described embodiments an electromagnetic brake 19 (119) is mounted on the swivel chamber 3 (103). Alternatively, it may be fitted to a frame structure located outside the swivel chamber 3 (103). Further, a person sensor 21 (121) may be fitted to the wall or ceiling of the room. The electromagnetically operated valve 13 (113) may be replaced with an electrically driven actuator to open and close the outlet valve 10*a* (110*a*).

In the apparatus shown in FIG. 1 a heat ray sensor 29 is fitted to the foremost end of the rod 28. However, the present invention should not be limited only to this. Any type of fire sensor or infrared ray detector may be fitted to the wall or the ceiling of the room to direct the swivel chamber 3 to a fire source in response to the detection of the location of the fire.

Further, in the modified apparatus shown in FIG. 9 a pair of fire sensors 135 and 136 are provided at the elevated position in the room 137 to detect an occurrence of fire. However, the present invention should not be limited only to this. Alternatively, a single infrared ray detector may be used to detect a fire. Further, a heat ray sensor or the like may be fitted to the foremost end of the rod 122 so that the foremost end part of the rod 122 is caused to expand to the position located in the proximity of the fire source in response to the output of the heat ray sensor or the like.

Further, in the modified apparatus a tilting mechanism is provided to adjust the height of the rod 122. However, the tilting apparatus is not essential, the ejection of a fire extinguishing agent may be carried out after expanding the rod in the horizontal direction so that the nozzle is located just above the fire source.

As described above, the present invention may be embodied in many difference manners and it should be construed that these changes or modifications are included within the scope of the invention as defined in the appended claims.

Finally, advantageous features of the invention will be described below.

1. Effective initial fire extinguishing can be achieved, because the fire extinguishing agent is ejected to the position in the vicinity of the fire source.

2. The apparatus is constructed of inexpensive component parts and therefore it can be manufactured at a reduced cost.

3. A fire alarm can be generated in the form of a sound simulating a voice of a man by actuating the announcing circuit.

4. By virtue of the provision of the person sensor, the ejection of the extinguishing agent can be interrupted by a person staying in the room.

What is claimed is:

1. A fire extinguishing apparatus comprising:

a casing;

a tank mounted on said casing and containing a pressurized fire extinguishing agent;

swivel means mounted on said casing and rotatable about a generally vertical axis, said swivel means having a chamber;

a pipe for providing fluid communication between said chamber and said tank;

valve means mounted on said pipe for normally interrupting the communication between said tank and said chamber;

drive means mounted on said casing for rotatably driving said swivel means;

a first axially-expansible hollow rod secured at one end to said swviel means and disposed generally horizontally, said first hollow rod having a second end and an interior in fluid communication with an interior of said chamber;

a second axially-expansible hollow rod having a first end coupled to said second end of said first rod;

bending means pivotally coupling said second rod first end to said first rod second end, said bending means having a passage therein to allow communication between the interiors of said first and second rods when said second rod is disposed at substantially a right angle with respect to said first rod;

lock means mounted within said first rod and releasably engaging said bending means to hold said second rod in substantially coaxial relation to said first rod where communication between the interiors of said first and second rods is closed;

disengaging means for disengaging said lock means from said bending means to cause said bending means to cause said second rod to pivot downward by the force of gravity to form said right angle with said first rod;

fire sensor means mounted on said second hollow rod for detecting a fire and outputting a detecting signal;

control means responsive to said detecting signal for actuating said drive means to rotate said swivel means for moving said first hollow rod into a position pointing to a source of said fire, said control means being responsive to said detecting signal to open said valve means to feed said pressurized fire extinguishing agent to said chamber so that the fire extinguishing agent is fed to said first hollow rod to axially expand it, said control means responsive to said detecting signal to cause said disengaging means to disengage said locking means to discharge said fire extinguishing agent toward said source of fire; and braking means, disposed in said chamber and within said first rod and controlled by said control means, for actuating said disengaging means for stopping axial expansion of said first rod when said second rod free end is substantially adjacent said fire source, in response to said detecting signal.

2. A fire extinguishing apparatus according to claim 1, wherein said fire sensor means comprises first and second sensors mounted on the free end of said second rod in juxtaposed relation and outputting first and second detecting signals, respectively, said control means being responsive to said first detecting signal for actuating said drive means to rotate said swivel means for moving said second rod into a position close to said source of said fire, said control means being responsive to said first and second detecting signals for actuating said drive means to finely rotate said swivel means so that signal levels of said first and second detecting signals become equal to each other.

3. A fire extinguishing apparatus according to claim 1, wherein said control means further comprises an alarm circuit responsive to said detecting signal for generating an alarm sound simulating a human voice.

4. A fire extinguishing apparatus according to claim 3 further comprising a sensor for sensing a person in the vicinity of the apparatus, and for outputting a sensing signal, said control means being responsive to said detecting signal and said sensing signal for operating said alarm circuit.

5. Apparatus according to claim 1 wherein said braking means includes:

a wire having a first end and a second end which is coupled to said disengaging means, said wire being disposed within said first hollow rod;

a reel around which said wire first end is wrapped, said reel being rotatably mounted in said chamber so that when said first rod axially expands, said wire is unwrapped as said reel rotates; and electromagnetic brake means, controlled by said control means for braking the rotation of said reel in response to said detecting signal to cause said wire to become taut whereby said axial expansion of said first rod forces said disengaging means to disengage said lock means.

6. A fire extinguishing apparatus for installation in a room, comprising:

a casing;

a tank mounted on said casing and containing a pressurized fire extinguishing agent;

swivel means mounted on said casing and rotatable about a generally vertical axis, said swivel means having a chamber;

a pipe for providing communication between said chamber and said tank;

valve means mounted on said pipe for normally interrupting the communication between said tank and said chamber;

first drive means mounted on said casing rotatably driving said swivel means;

an axially-expansible hollow rod secured at one end to said swivel means and disposed generally horizontally, said hollow rod having a free end an interior in fluid communication with an interior of said chamber;

closure means normally engaging the free end of said hollow rod to close it;

means for disengaging said closure means from the free end of said hollow rod to open it;

first and second fire sensor means for detecting a fire and outputting first and second detecting signals, respectively, each of said sensors being mounted on a wall of said room and being rotatable about a generally vertical axis, said sensors being disposed a predetermined distance apart from each other in a horizontal direction;

second and third drive means for rotatably driving said first and second fire sensors respectively;

first and second angular position detectors for detecting the angular position of said first and second fire sensors to output first and second position signals;

control means responsive to said first and second detecting signals for actuating said second and third drive means to rotate said fire sensors to point to said fire, and for reading said first and second position signals when said first and second fire sensors are directed to the fire source, said control means responsive to said detecting and position signals for calculating the positon of the fire source, said control means responsive to said detecting and position signals for actuating said first drive means to rotate said swivel means for moving said hollow rod into the calculated position, said control means being responsive to said detecting and position signals to open said valve means to feed said pressurized fire extinguishing agent to said chamber so that the fire extinguishing agent is fed to said hollow rod to axially expand it, said control means responsive to said detecting and position signals to actuate said disengaging means to open the free end of said hollow rod to discharge said fire extinguishing agent toward said source of fire when the free end of said rod reaches said calculated position; and braking means, disposed on said swivel means and within said hollow rod and controlled by said control means, for stopping axial expansion of said rod when said free end is substantially adjacent said fire source, in response to said position signals.

7. A fire extinguishing apparatus according to claim 6, wherein said swivel means is pivotally connected to said casing for moving said hollow rod downwardly, said drive means driving said swivel means and casing together for rotation, and further including actuator means mounted within said casing for pivotally moving said swivel means, said control means being responsive to said detecting signal for actuating said actuating means to pivotally move said swivel means so that the axis of said hollow rod is directed to said source of said fire.

8. A fire extinguishing apparatus comprising:

a casing;

a tank mounted on said casing and containing a pressurized fire extinguishing agent;

a chamber mounted on said casing and rotatable about a vertical axis;

a pipe for providing fluid communication between said tank and said chamber;

valve means mounted on said pipe for normally interrupting communication between said tank and said chamber;

drive means for rotatably driving said chamber;

an axially-expandable hollow rod having a first end coupled to an in fluid communication with said chamber, and an open end;

closure means normally closing said rod open end;

means for disengaging said closure means to open said rod open end;

a fire sensor for detecting a fire and providing a detecting signal corresponding to a position of said fire;

braking means, disposed in said chamber and in said hollow rod, for arresting the axial expansion of said hollow rod; and control means responsive to said detecting signal for activating said drive means to rotate said chamber until said hollow rod is pointing to said fire, and for opening said valve means to allow said pressurized fire extinguishing agent to move from said tank, through said pipe and said chamber to said hollow rod to axially expand it, and for controlling said braking means to arrest said axial expansion when said free end is adjacent said fire, and for activating said disengaging means to permit said fire extinguishing agent to exit said rod open end to said fire.

9. Apparatus according to claim 8 wherein said braking means includes:

a wire having a first end and a second end which is coupled to said rod free end, said wire disposed within said hollow rod;

a reel around which said wire first end is wrapped, said reel being rotatably mounted in said chamber so that when said rod axially expands, said wire is unwrapped as said reel rotates; and electromagnetic brake means, controlled by said control means, for braking the rotation of said reel in response to said detecting signal.

* * * * *